US006799631B2

(12) United States Patent
Acre

(10) Patent No.: US 6,799,631 B2
(45) Date of Patent: Oct. 5, 2004

(54) HEAT EXCHANGER WITH INTEGRATED FLOW CONTROL VALVE

(75) Inventor: James A Acre, Barker, NY (US)

(73) Assignee: Delphi Technologies, Inc., Troy, MI (US)

( * ) Notice: Subject to any disclaimer, the term of this patent is extended or adjusted under 35 U.S.C. 154(b) by 108 days.

(21) Appl. No.: 10/339,525

(22) Filed: Jan. 9, 2003

(65) Prior Publication Data

US 2004/0134650 A1 Jul. 15, 2004

(51) Int. Cl.[7] ..... F28F 27/02; F28F 9/02

(52) U.S. Cl. ..... 165/297; 165/298; 165/103; 123/41.1; 123/41.09; 236/34.5; 137/599.14; 137/876

(58) Field of Search ..... 165/103, 297, 165/298, 283, 284; 123/41.08, 41.09, 41.1; 236/34.5; 137/599.14, 876

(56) References Cited

U.S. PATENT DOCUMENTS

| | | | | | |
|---|---|---|---|---|---|
| 2,650,767 | A | * | 9/1953 | Nemmer et al. | 165/297 |
| 3,353,590 | A | * | 11/1967 | Holman | 165/297 |
| 4,156,408 | A | * | 5/1979 | Protze | 123/41.09 |
| 4,169,491 | A | * | 10/1979 | Bajka | 137/876 |
| 4,432,410 | A | | 2/1984 | Cadars | 165/32 |
| 5,305,826 | A | | 4/1994 | Couetoux | 165/103 |
| 5,632,256 | A | * | 5/1997 | Eibl | 165/297 |
| 5,806,479 | A | * | 9/1998 | Bauer | 123/41.14 |
| 5,979,548 | A | * | 11/1999 | Rhodes et al. | 165/103 |
| 6,019,171 | A | | 2/2000 | Johnson | 165/174 |
| 6,161,614 | A | * | 12/2000 | Woodhull, Jr. et al. | 165/297 |
| 6,314,920 | B1 | | 11/2001 | Suzuki et al. | 123/41.1 |
| 6,471,133 | B1 | * | 10/2002 | O'Flynn et al. | 236/34.5 |

FOREIGN PATENT DOCUMENTS

| | | | |
|---|---|---|---|
| EP | 0053003 | * | 6/1982 |
| EP | 0287449 | * | 4/1988 |
| FR | 2602548 | * | 2/1988 |
| JP | 3-175242 | * | 7/1991 |

* cited by examiner

*Primary Examiner*—John K. Ford
(74) *Attorney, Agent, or Firm*—Patrick M. Griffin

(57) ABSTRACT

A U flow radiator 10 with a header tank 12 split into inlet and outlet sides I and O by a lengthwise divider wall 18 has a coolant inlet consisting of a cylindrical pipe 22. A hollow cylindrical barrel 24 co extensive and coaxial with pipe 22 and extending across divider wall 18, with cut outs 26 and 28 opening respectively into both sides I and O. A thin walled, hollow cylindrical sleeve 30 turns within barrel 24 with windows 36 and 38 that alternately block or open the cut outs 26 and 28, or open both partially. A rotary actuator 40 turns sleeve 30 within barrel 24. Coolant can be selectively routed all to the tank outlet side O, by passing the radiator 10 for quick warm up. After warm up, coolant can be routed to I or O in desired proportions to increase or decrease cooling capacity. With high engine cooling demand, all coolant is routed to the inlet side I and all coolant passes through radiator 10.

4 Claims, 6 Drawing Sheets

HEAT EXCHANGER WITH INTEGRATED FLOW CONTROL VALVE

TECHNICAL FIELD

This invention relates to heat exchangers, such as vehicle engine cooling radiators, and to a flow control valves therefore control valve that is integrated into the inlet of a U flow type radiator in a simple and non flow restrictive fashion.

BACKGROUND OF THE INVENTION

Flow control in vehicle engine cooling radiators has historically consisted of just a passively acting thermostat which, reacting to coolant temperature, blocks flow into the radiator to a greater or lesser degree, by passing the remainder of the flow through an by pass path external to the radiator. When wide open at the highest coolant temperature, all flow goes through the radiator. This standard system does not offer a high degree of control, generally using a thermally expandable wax material. Other systems attempt to add an extra degree of control by deliberately and externally heating the wax material to expand it, generally electrically heating it. There has been a recent trend, at least in published patents, toward active, electronically controlled flow control valves. An example may be seen in U.S. Pat. No. 6,314,920. The system shown there requires an electronically controlled coolant pump, and the valve is also external to the radiator, requiring an external by pass circuit around the radiator.

Other patents show control valves internal to the header tanks of the radiator, either passively or actively operated. One example is U.S. Pat. No. 5,305,826 shows a plunger operated double valve, either actively or passively controlled, that simultaneously blocks or opens both the inlet into a radiator of the two pass type, as well as blocking or opening a by pass passage between the two passes. As disclosed, the valve, being just downstream of the inlet, would represent a severe flow restriction within the header tank, in addition to the pressure drop that inherently happens as flow enters a header tank inlet and makes a ninety degree turn. Likewise, U.S. Pat. No. 4,432,410 shows a passively acting by pass valve located within the header tank, just downstream of the inlet. This, also, would represent a significant additional flow restriction and pressure drop. Coolant flow induced pressure drop through the inlet, outlet and header tank of a radiator is a serious issue, and features that add significantly to it are not preferred, despite the desirability of having an internal flow control valve, as opposed to an external flow control valve.

SUMMARY OF THE INVENTION

The invention provides an actively controllable radiator flow control valve that is internal to the radiator header tank, but which is integrated therewith in such a way as to not add a large pressure drop.

In the embodiment disclosed, the radiator is a U flow design, with two rows of flow tubes, in which one header tank is split between inlet and outlet portions by a dividing wall, with the inlet on one side and the outlet/pump inlet on the other side. The other header tank would act only to return the flow from the inlet to outlet portion of the first header tank. The physical coolant inlet to the first header tank is a cylindrical barrel that extends not only outside of the tank, as a conventional inlet fitting would, but also through the dividing wall and across the whole width of the interior of the tank. The exterior, outer end of the barrel provides the coolant inlet to the tank, while the inner surface provides a stationary outer housing and guide for the movable inner member of the control valve. Windows in the barrel allow open into the inlet and outlet side of the first header tank, one on either side of the dividing wall. The movable portion of the valve is a hollow cylindrical sleeve, closely and rotatably mounted within the outer barrel. One end of the sleeve opposite the inlet end of the outer barrel, can be turned back and forth about its central axis by a motor or similar actuator. Cut outs in the inner sleeve register with the windows in outer barrel, either completely or partially, or not at all, depending on the relative turned position of the inner sleeve.

Coolant flow entering the exterior end of the outer barrel then flows inside the close fitting inner sleeve, essentially just as it would with a conventional radiator tank inlet, and with no significant additional pressure loss. Depending on the relative registration of the inner sleeve and outer barrel cut outs and widows, flow exits the inner sleeve, and flows into either just the outlet side of the header tank, for a complete by pass of the radiator, or just the inlet side of header tank, forcing all flow through the radiator, or a mixed flow. Mixed flow can constitute the normal radiator operation, as determined by sensed engine or coolant temperature and consequent cooling demand, rather than the conventional operation of total flow through the radiator at all times other than initial warm up. This is feasible since a U flow radiator is inherently more efficient and the valve adds little additional pressure drop. Operating the radiator normally with some degree of by pass saves pump work and energy, regardless of how the pump is driven. Total radiator flow can then be reserved for severe engine cooling requirements.

DESCRIPTION OF THE PREFERRED EMBODIMENT

Figure 1:
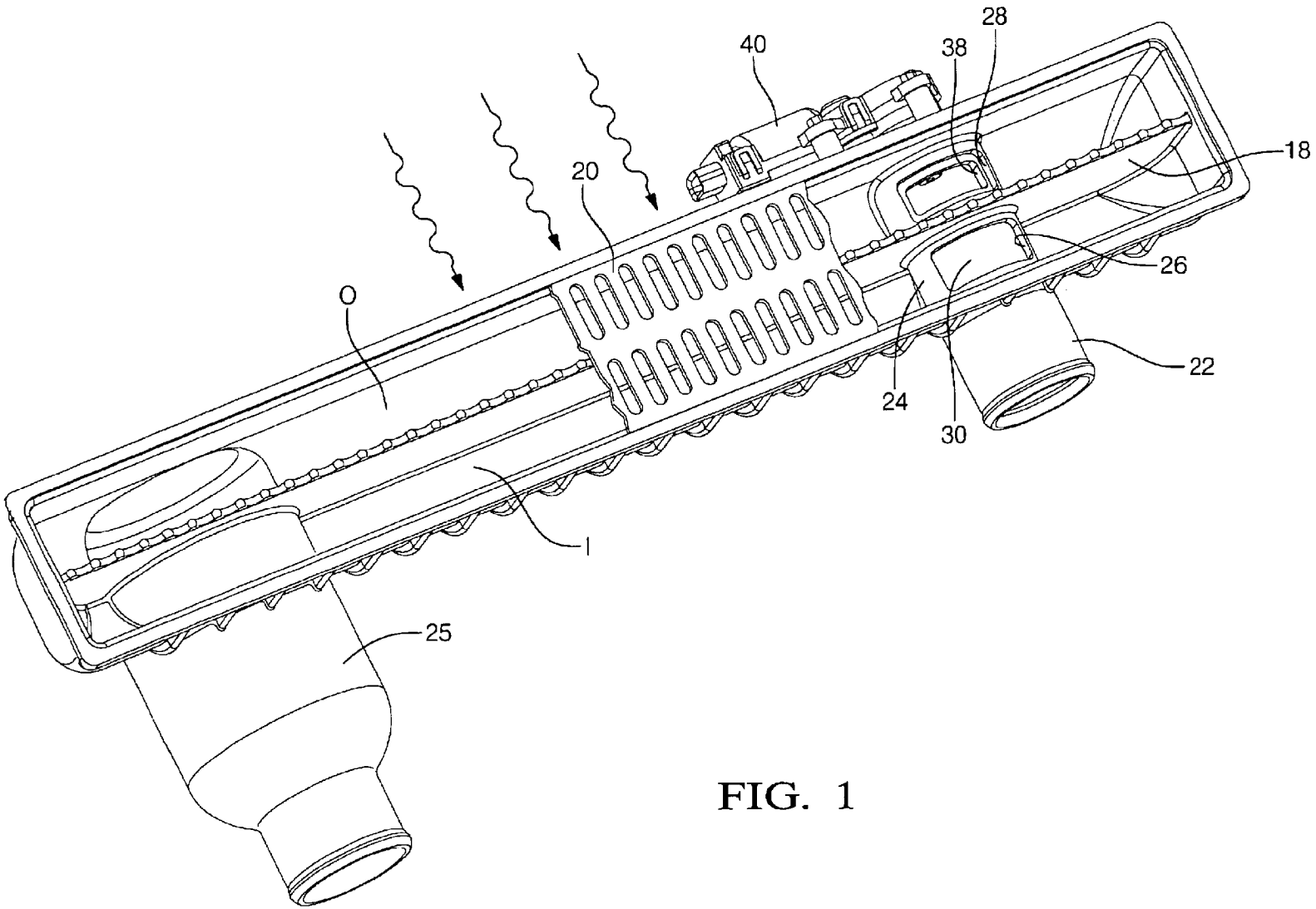
FIG. 1 is perspective view of a radiator incorporating the flow control valve of the invention.
Figure 2:
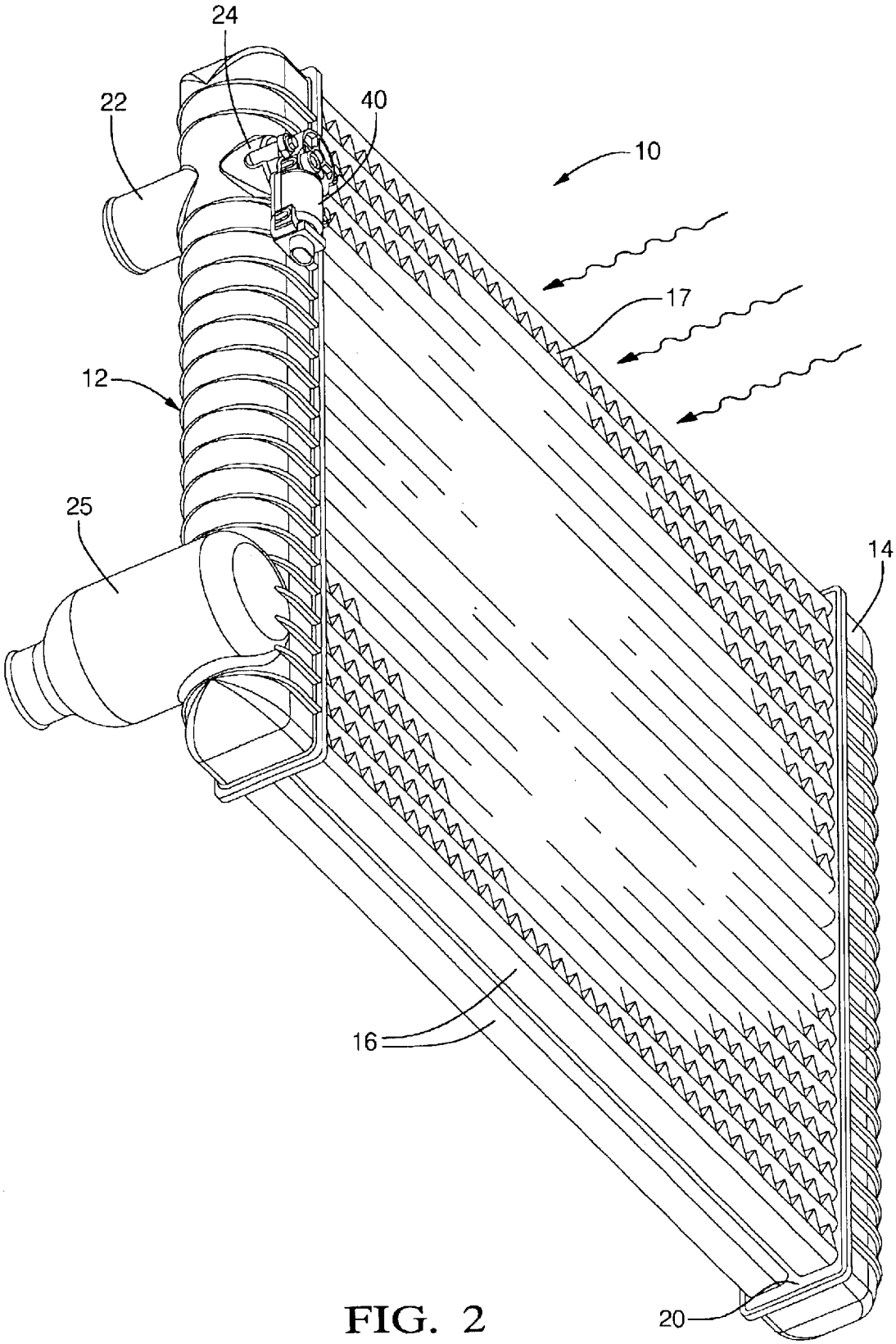
FIG. 2 is a perspective view of the inside of just the inlet/outlet or first header tank.

Referring first to FIGS. 1 and 2, a heat exchanger of the U flow type, in this case a vehicle engine cooling radiator, designated generally at 10, is the U flow type, with a first, vertically oriented, inlet/outlet header tank, designated generally at 12, a second or return tank 14, and regularly spaced pairs of flow tubes, two of which are shown at 16. The pairs of flow tubes are separated by conventional, corrugated, air cooling fins 17, brazed in place. External air flow across the outside of the tubes 16 is in the direction shown by the wavy arrow, while the internal coolant flow that is not by passed, as described below, flows in a U pattern from tank 12, to 14, and back. As seen in FIG. 2, the coolant flow pattern is determined by a dividing wall 18 that runs the length of the inside of first tank 12, mating in sealed fashion to the inside of a header plate 20 to divide tank 12 into a front, coolant inlet side I and a rear, coolant outlet side O. Thus, the rear "half" of radiator 10 (the rear set of tubes 16) sees the hottest coolant as well as the hottest air flow (air which has already flowed over the front "half" of radiator 10) while the front "half" of radiator 10 (the front set of tubes 16), in which the coolant flow has already been partially cooled sees the coolest air flow. This provides the most thermally efficient pattern of air-coolant temperature differentials, and is inherently more efficient than a single flow radiator. The invention works in conjunction with this internal structure of header tank 12 to provide an improved flow control valve, so as to take even more advantage of the inherent thermal efficiency advantage of the U flow pattern.

Figure 3:
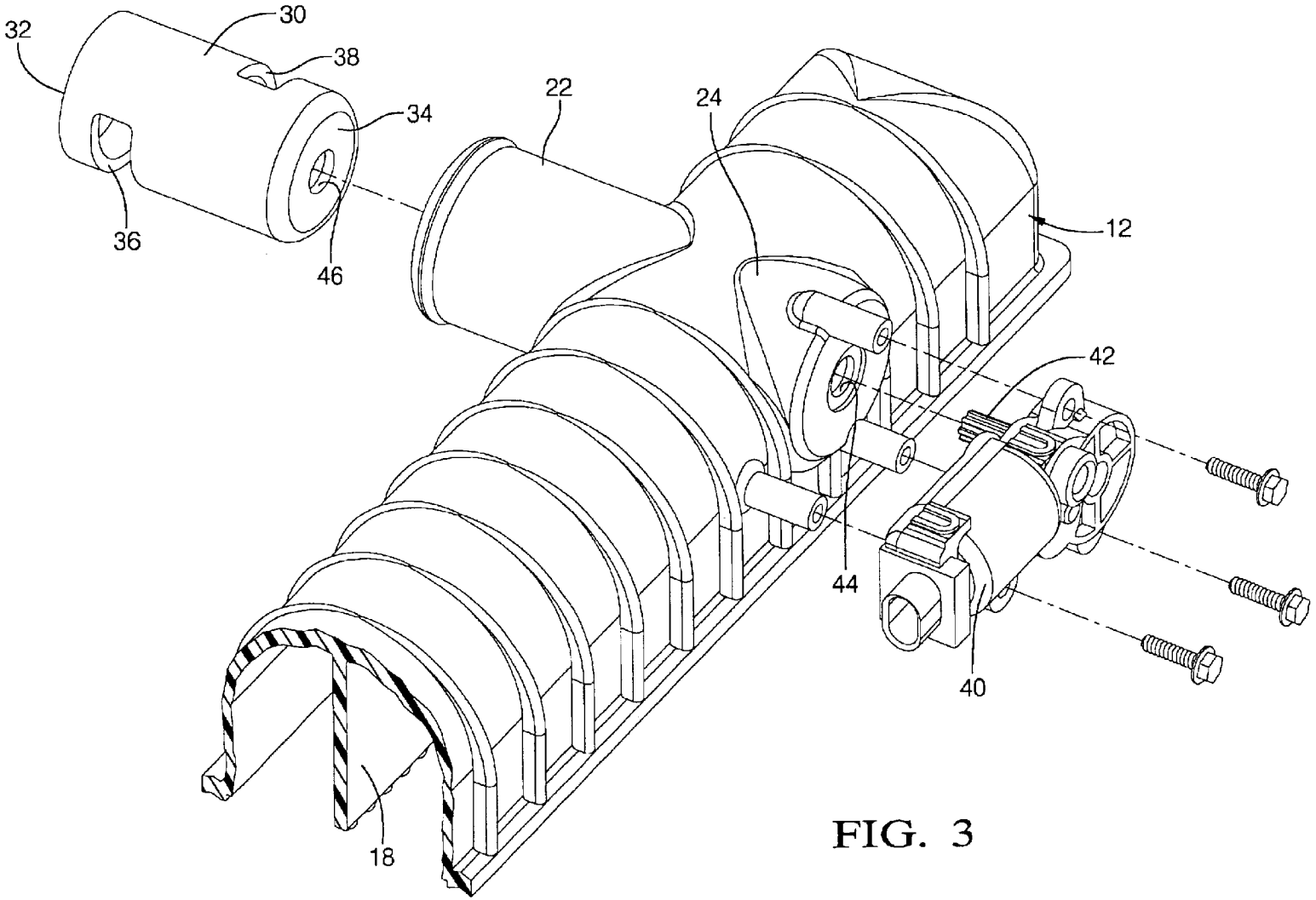
FIG. 3 is a disassembled view of the control valve and its actuator.

Still referring to FIGS. 2 and 3, the coolant inlet fitting for the first tank 12 is, to all external appearances, a conventional, hollow cylindrical stub pipe 22 to which a coolant hose would be clamped. Normally, such a stub pipe 22 would do nothing but open through the outer wall of tank 12, at about ninety degrees thereto, and open only into the inlet side I of tank 12. Given the ninety degree turn that the coolant flow makes at and through the tank wall, a significant pressure drop is inevitable. In the embodiment of the invention disclosed, however, the sub pipe 22 is, in effect, the exterior protrusion of a hollow cylindrical barrel, indicated generally at 24, that extends through one side wall of tank 12, across and through the entire width of the header tank 12, protruding slightly at the opposed side wall (as best seen in FIG. 3), but which is open to the exterior of tank 12 only at the stub pipe portion 22. Barrel 24, in and of itself, being essentially just an extension of the hollow cylindrical stub pipe 22, would not add any additional pressure drop, but, in the absence of other provisions, would also not allow any coolant inflow. However, additional structural features, described below, allow the barrel to provide both an inlet and part of a coolant flow control valve. Further down on first tank 12, well below inlet 22, is a pump housing 25, which is open only to the outlet side O of tank 12. As shown, housing 25 would contain a non illustrated electric pump, but the invention here is not limited to use of an electric pump only. The pump powers coolant flow so that, as coolant is pumped out of the outlet side I of first header tank 12 and into the non illustrated engine cooling jacket, coolant is pulled out of the cooling jacket and into pipe 22, where its flow path within radiator 10, prior to reaching the pump again is determined by additional structure described next.

Still referring to FIGS. 2 and 3, barrel 24 has two windows or cut outs 26 and 28, each generally rectangular in a planar, projected view, and one located on either side of the dividing wall 18, so as to open to the interior of the first header tank 12 in its inlet and outlet sides I and O respectively. Closely received inside of barrel 24 is a hollow cylindrical sleeve, indicated generally at 30, with an open end 32, a closed end 34, and relatively thin wall through which a pair of axially spaced, diametrically opposed windows 36 and 38 are cut, also generally "rectangular". The windows 36 and 38 are located near the open end 32 and closed end 34 respectively. Sleeve 30 is inserted into barrel 24 until its closed end 34 abuts with the protruding end of barrel 24 and its open end 32 faces and is concentric to inlet pipe 22. Sleeve 30's outer surface fits closely and turnably within the inner surface of barrel 24, and would be maintained co extensive and co axial with barrel 24 if it were either rotated or moved axially back and forth. The thin wall of sleeve 30 reduces the inner diameter of barrel 24 only slightly, and it becomes, in effect, almost an extension of the inlet pipe 22 inserted within barrel 24. At the opposed outer wall of tank 12, a rotary type actuator 40 is mounted, which has an electric motor that turns a splined shaft 42. Shaft 42 enters a through hole 44 in the back of barrel 24 and is inserted non turnably into a closed ended hole 46 in the closed end 34 of sleeve 30. A suitable seal would surround shaft 42 so as to prevent any leakage out of barrel 24. Sleeve 30, turned within barrel 24 by actuator 40, provides an improved coolant flow within radiator 10, as described next.

Figure 4:
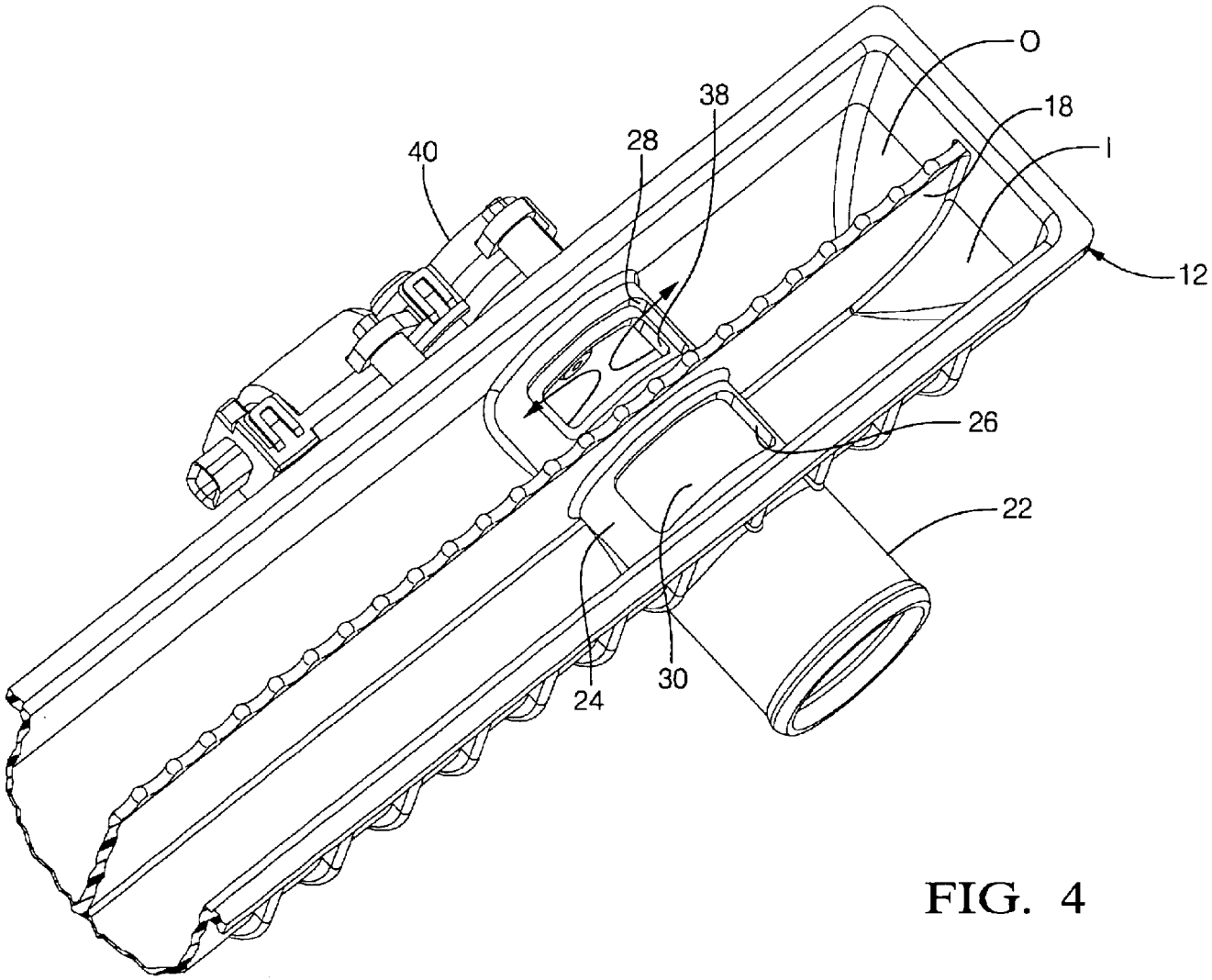
FIG. 4 is a perspective view of the inside of the upper end of the inlet/outlet tank, showing the flow control valve in a full by pass mode.

Referring next to FIG. 4, during engine warm up, actuator 40, based on a temperature signal or other indication of the warm up condition, would turn sleeve 30 within barrel 24 to the point shown, where the barrel cut out 26 is completely blocked by the wall of sleeve 30, while the sleeve window 38 and barrel cut out 28 are fully registered and aligned. As a consequence, all coolant entering stub pipe 22 flows directly within sleeve 30, with very little restriction or pressure drop, due to the coaxial orientation of sleeve 30 to both pipe 22 and barrel 24, and its relatively thin wall. Coolant flows out of sleeve 30 only through window 38 into the outlet side O of first header tank 12. From there, it would be pulled down and out of pump housing 25, without ever flowing through the radiator tubes 16. As such, the engine would be able to warm up quickly, with no need for a by pass flow path external to radiator 10. Coolant flowing inside of sleeve 30, and then turning 90 degrees to enter the tank outlet side O, would not undergo significantly more pressure drop than it would by just flowing through stub pipe 22 and into the interior of a regular tank. Thus, the sleeve 30 uniquely cooperates with barrel 24 (which is effectively an extension of pipe 22) to create the valving action at essentially no cost to performance. Benefits not only include the more rapid engine warm-up, but also a pre warming of the header tank 12 to reduce thermal stress later. As disclosed, the inlet side I becomes fully blocked only as the outlet side O becomes fully opened. However, the shape and orientation of window 38 could be changed so that cut out 24 remained blocked by sleeve 30 as window 38 registered progressively more or less with cutout 28, so as to meter and regulate the degree of by pass flow.

Figure 5:
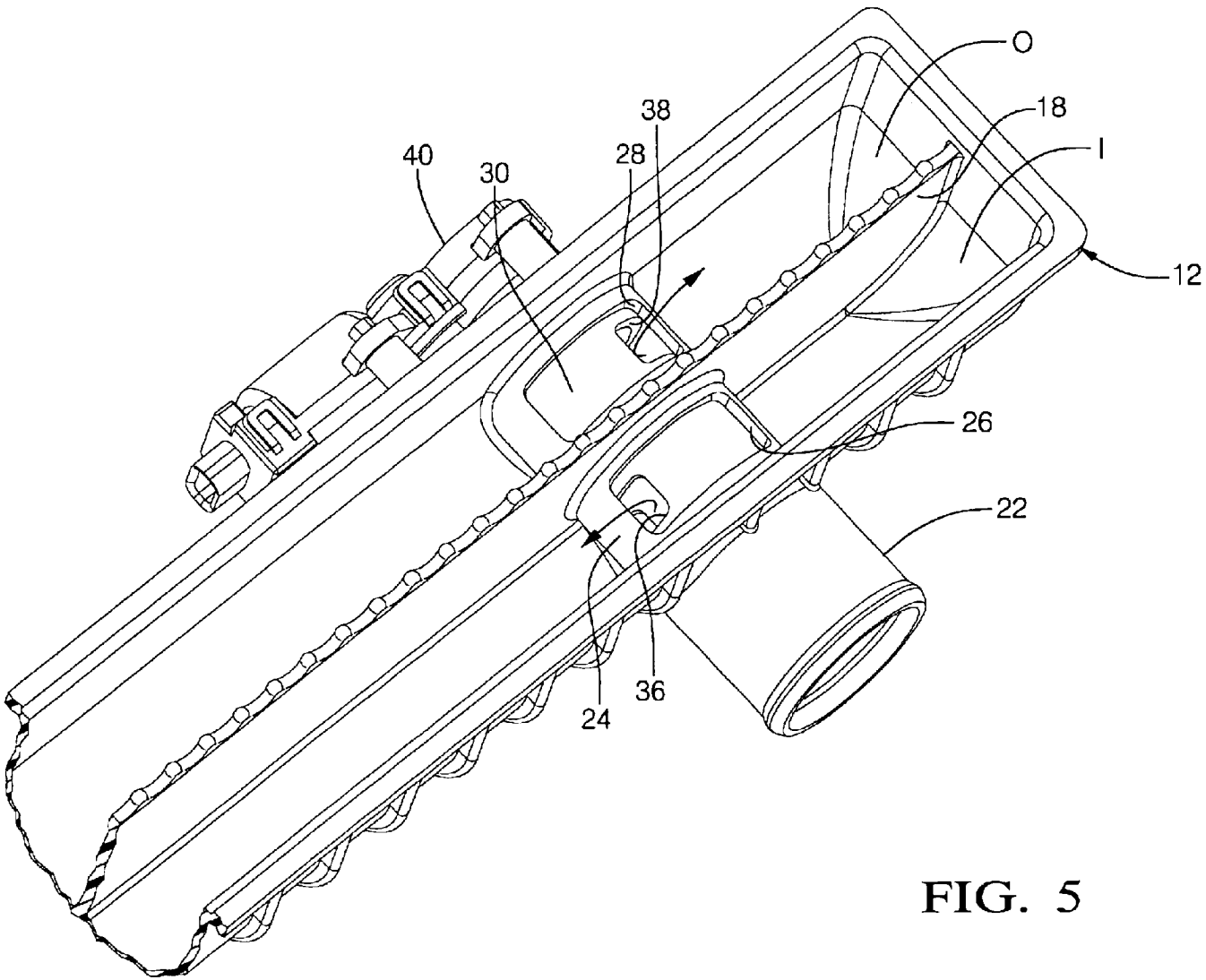
FIG. 5 shows the flow control valve in a mixed flow mode.

Referring next to FIG. 5, as the engine warms up and some external heat rejection becomes necessary, actuator 40 turns sleeve 30 within barrel 24 until each sleeve window 36 and 38 is registered partially with a respective barrel cut out 26 and 38. This allows some coolant flow into tank inlet side I, and some directly into outlet side O. That coolant flowing into inlet side I will flow through one row of tubes 16, into return tank 14 and back through the other row of tubes 16 and into tank outlet side O, rejecting heat to the air flow in the process. During normal operation, post engine warm up, but not under extreme conditions, it is contemplated that there would always be some by pass flow directly into the tank inlet side O. As such, relatively more of the sleeve window 38, and relatively less of the sleeve widow 36, would be open than is shown in FIG. 5. Again, this could be provided by how far actuator 40 turned sleeve 30 within barrel 24, as based on coolant temperature or other sensed parameters. The inherent efficiency of the U flow radiator design shown is such that some radiator cooling capacity could normally be held "in reserve" for extreme conditions. This, as opposed to the normal radiator flow pattern where all coolant flow fully through the radiator once engine warm up is completed.

Figure 6:
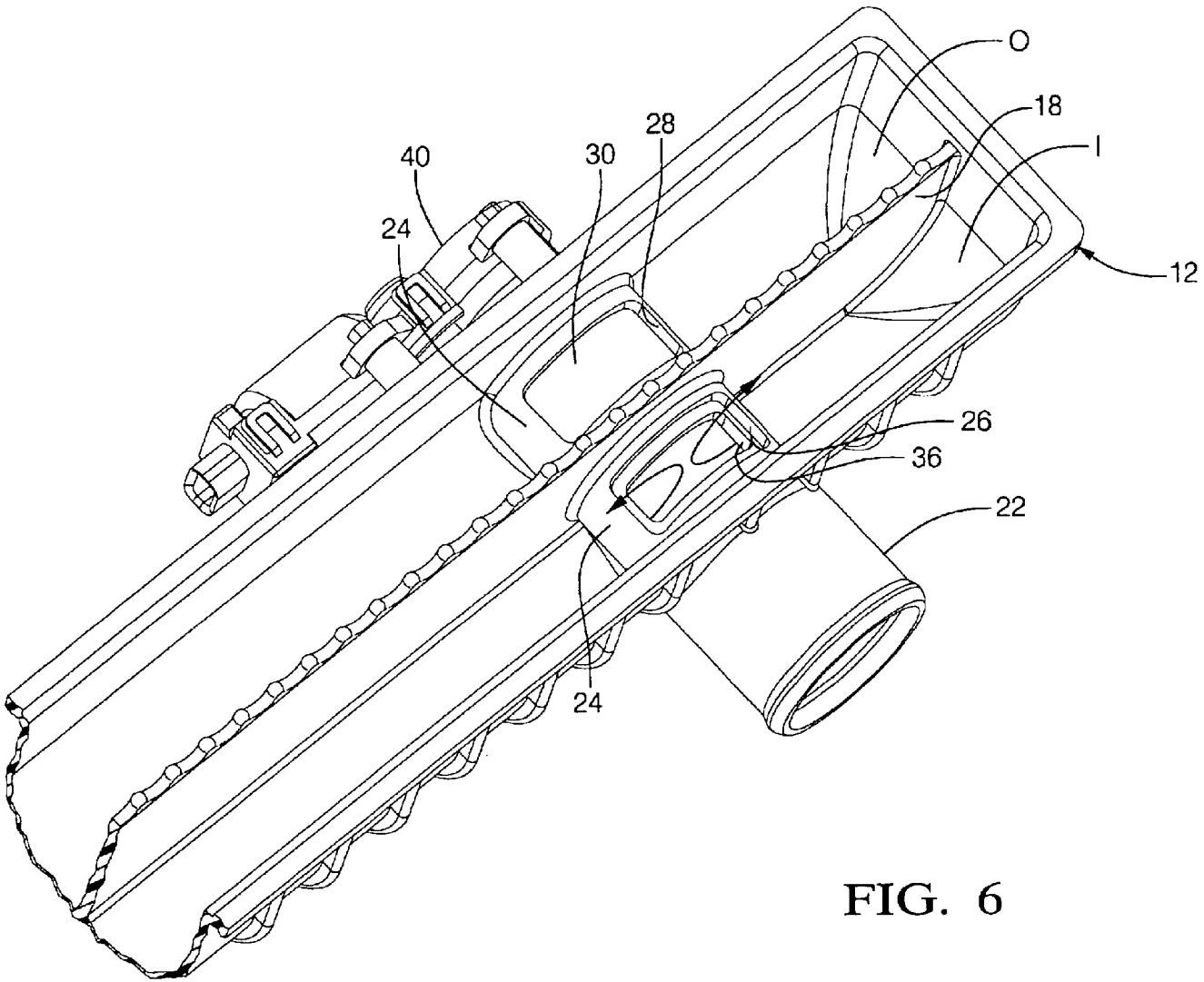
FIG. 6 shows the flow control valve in a full radiator flow mode.

Referring finally to FIG. 6, in the case of extreme conditions where more than normal cooling capacity was needed, then sleeve 30 would be turned so as to fully block the barrel cut out 28 in the tank outlet side O, and to fully register the sleeve window 36 with the barrel cut out 26 in the tank inlet side I. Now, all flow runs through the radiator tubes 16 and back, and none is by passed, for maximum cooling capacity. Again, it is not contemplated that this would be the normal radiator flow path, as in a conventional radiator.

Variations in the disclosed embodiment could be made within the spirit of the invention. A downflow design with top and bottom tanks, rather than vertical tanks, could be used. The radiator could be divided up into a U flow pattern in a side to side, rather than the back to front, design shown. That is, the divider wall 18 could run across the center width of the tank 12, rather than lengthwise. A similar sleeve turning within a similar barrel that opened into both the inlet and outlet sides of the tank would provide the same controlled flow advantages. Other shapes could be provided for the barrel cut outs and sleeve windows, other than the rectangular (in projection) shape disclosed, such as triangular, trapezoidal, etc, which would provide even more control of the flow rates as the sleeve turned to progressively register and align the two. Since one of the main advantages is the close fit of the sleeve within the barrel, coaxial to both the barrel and the inlet pipe, with the attendant low pressure drop, it would be theoretically possible to move a similarly close fitting sleeve axially back and forth within the barrel so as to align and misalign, block and un block, matching windows and cut outs. This could create a similar flow pattern. However, the rotary action shown is convenient and compact, and there are existing rotary actuators that would serve that purpose well. Potentially, a combination of both axial plunging and rotary turning could be used, since both motions would be well guided by the close fit of hollow cylindrical sleeve within cylindrical barrel.

What is claimed is:

1. A radiator 10 having a U flow coolant flow pattern with a header tank 12 divided into an inlet side I and an outlet side O by a central dividing wall 18 and an opposed return tank 14, said header tank 12 further having a cylindrical pipe inlet 22 through which inlet coolant flows, characterized in that a low pressure drop coolant flow control valve is integrated into said header tank 12, comprising, a cylindrical barrel 24 co extensive with said pipe inlet 22 and extending within said header tank 12 across said divider wall 18, said barrel 24 having cut outs 26, 28 opening into each of said header tank inlet sides I and O respectively, a hollow cylindrical sleeve 30 that fits closely within barrel 24, having an open end 32 that is concentric to inlet pipe 22 so that coolant entering inlet pipe 22 enters the hollow interior of sleeve 30 with substantially no additional restriction, and a pair of windows 36, 38 alignable with said barrel cut outs 26, 28 respectively so as to alternately open or block said cut outs 26 and 28, or to partially open both cut outs 26 and 28, and actuator means 40 to move sleeve 30 within barrel 24 so as to selectively align said respective cut outs 26,28 and windows 36, 38, thereby opening inlet pipe 22 only to header tank inlet side I, or only to header tank outlet side O, or partially to both sides I and O.

2. A radiator 10 and integrated flow control valve according to claim 1, further characterized in that said actuator means 40 is a rotary actuator that turns sleeve 30 within barrel 24.

3. A radiator 10 and integrated flow control valve according to claim 1, further characterized in that said central dividing wall runs lengthwise within header tank 12.

4. A radiator 10 and integrated flow control valve according to claim 1, further characterized in that said tanks 12 and 14 are vertically oriented.

* * * * *